United States Patent [19]

Reen

[11] 3,993,445

[45] Nov. 23, 1976

[54] SINTERED FERRITIC STAINLESS STEEL

[75] Inventor: Orville W. Reen, Lower Burrell, Pa.

[73] Assignee: Allegheny Ludlum Industries, Inc., Pittsburgh, Pa.

[22] Filed: Nov. 27, 1974

[21] Appl. No.: 527,575

[52] U.S. Cl. ..... 29/182.5; 29/182; 75/126 C; 75/126 Q; 75/126 R

[51] Int. Cl.[2] ..... B22F 3/00; C22C 38/18

[58] Field of Search ..... 29/182, 182.5; 75/126 R, 126 C, 126 Q, 200, 201

[56] References Cited

UNITED STATES PATENTS

| | | | |
|---|---|---|---|
| 3,075,839 | 1/1963 | Dulis | 75/126 C |
| 3,748,105 | 7/1973 | Reen | 29/182.1 |
| 3,856,515 | 12/1974 | Brandis | 75/126 C |

*Primary Examiner*—Samuel W. Engle
*Assistant Examiner*—Donald P. Walsh
*Attorney, Agent, or Firm*—Vincent G. Gioia; Robert F. Dropkin

[57] ABSTRACT

A sintered ferritic stainless steel having an overall density no greater than 80% of full density. The steel consists essentially of, by weight, 12 to 30% chromium, up to 8% molybdenum, up to 2% silicon, up to 1.5% manganese, up to 0.04% phosphorus, up to 0.04% sulfur, up to 0.15% carbon, balance iron.

7 Claims, No Drawings

SINTERED FERRITIC STAINLESS STEEL

The present invention relates to sintered ferritic stainless steel.

For applications requiring good corrosion resistance, and particularly to the chloride ion, sintered powder metal parts have been prepared from austenitic stainless steels. Austenitic stainless steel parts are, however, somewhat expensive as they generally require costly additions of nickel.

Ferritic stainless steel parts would be a likely substitution for the more costly austenitic parts if they could be made with comparable corrosion resistance. As the likelihood of making ferritic parts with comparable corrosion resistance was not too high, sintered ferritic stainless steel parts have not met with much commercial success.

The present invention provides sintered ferritic stainless steel parts having corrosion resistance in chloride ion environments equivalent to presently produced pressed and sintered austenitic stainless steel parts. It is based upon the discovery that the corrosion resistance of sintered ferritic stainless steels having from 12 to 30% chromium and up to 8% molybdenum is unexpectedly high if the overall density of the steel is not greater than 80% of full density.

It is accordingly an object of the present invention to provide ferritic stainless steel having corrosion resistance in chloride ion environments equivalent to presently produced pressed and sintered austenitic stainless steel.

The present invention provides a sintered ferritic stainless steel having corrosion resistance in chloride ion environments equivalent to presently produced pressed and sintered austenitic stainless steel. The steel consists essentially of, by weight, 12 to 30% chromium, up to 8% molybdenum, up to 2% silicon, up to 1.5% manganese, up to 0.04% phosphorus, upt to 0.04% sulfur, up to 0.15% carbon, balance iron; and has an overall density no greater than 80% of full (cast) density. Its density is maintained below 80% of full density as its corrosion resistance in chloride ion environments increases with decreasing densities. Although it is not known why this happens, it is hypothesized that the finer pores which accompany higher densities induce a form of crevice corrosion. The term overall density is used as segregated sections of the steel might have densities in excess of 80% of full density. As a general rule the density of the steel will be between 68 and 80% of full density. There is, however, reason to believe that it can be as low as 45%.

Preferred chromium and molybdenum contents are respectively from 16 to 26% and from 2 to 6%. Particularly good steel has from 16 to 26% chromium, 2 to 6% molybdenum, up to 1.5% silicon, up to 0.5% manganese, up to 0.03% phosphorus, up to 0.03% sulfur, up to 0.04% carbon, balance iron.

The following examples are illustrative of several aspects of the invention.

Four sintered compacts were prepared from two different prealloyed powders having the composition and properties respectively set forth in Tables I and II.

TABLE I

| Powder No. | Composition (Wt. Percent) C | Mn | P | S | Si | Cr | Mo | Fe |
|---|---|---|---|---|---|---|---|---|
| 1 | 0.023 | 0.12 | 0.007 | 0.003 | 0.81 | 21.07 | 6.06 | Bal. |
| 2 | 0.005 | 0.016 | 0.004 | 0.004 | 0.94 | 24.26 | 4.97 | Bal. |

TABLE II

| Powder No. | Mesh Size Distribution (Wt. Percent) −100/+200 | −200/+325 | −325 | Hall Flow (Secs/50g) | Apparent Density (g/cu cm) |
|---|---|---|---|---|---|
| 1 | 24.3 | 19.0 | 56.7 | 23.1 | 2.88 |
| 2 | 31.7 | 20.6 | 47.7 | 28.0 | 2.67 |

Two of the compacts (A and B) were prepared for pressing by blending 0.5 wt. percent stearic acid with Powder No. 1. The other two compacts (C and D) were similarly prepared by blending 0.5 wt. percent stearic acid with Powder No. 2. All four of the compacts were pressed in a mechanical press and sintered in dry hydrogen for one hour at a temperature of 2200° F. The full (cast) and sintered densities for the compacts are set forth in Table III. To achieve the sintered densities, the powders required green densities of about 65 and 75% of full densities. Compacting pressures to obtain these green densities were respectively about 25 and 45 tons per square inch.

TABLE III

| Compact | Full Density (g/cu cm) | Sintered Density (g/cu cm) | Sintered Density As a Percent of Full Density |
|---|---|---|---|
| A. | 7.73 | 6.04 | 78.1 |
| B. | 7.73 | 6.46 | 83.6 |
| C. | 7.75 | 5.92 | 76.4 |
| D. | 7.75 | 6.57 | 84.8 |

All four sintered compacts were exposed to the following corrosive environments.

1. Five percent neutral NaCl spray;
2. Immersion in aqueous solutions of 5, 10 and 20 weight percent NaCl
3. Immersion in aqueous solutions of 5, 10 and 20 weight percent $NH_4Cl$.

The results of the exposure are reported in Table IV.

TABLE IV

| Compact | 100 Hour Exposure To 5% Neutral Salt Spray (a) | 5% NaCl | 10% NaCl | 20% NaCl | 5% $NH_4Cl$ | 10% $NH_4Cl$ | 20% $NH_4Cl$ |
|---|---|---|---|---|---|---|---|
| A. | NR (b) | 508NR | 508NR | 508NR | 480NR | 480NR | 480NR |
| B. | NR | 480 | 48 | 48 | 480NR | 480NR | 24 |
| C. | NR | 508NR | 508NR | 508NR | 480NR | 480NR | 456 |
| D. | NR | 480 | 508NR | 508NR | 312 | 480NR | — |

(a) - ASTM Method B117
(b) - NR = No Rust

From Table IV it becomes evident that compact A has better corrosion resistance to chloride ion environments than compact B, and that compact C has similarly better corrosion resistance than compact D. It is also evident that compacts A and C have an overall density of less than 80% of full density whereas compacts B and D have overall densities in excess of 80% of full density. As a particular example, it is noted that compacts A and C showed no signs of rust after 508 hours exposure to a 5% NaCl solution whereas compacts B and D showed rust after 480 hours exposure.

It will be apparent to those skilled in the art that the novel principles of the invention disclosed herein in connection with specific examples thereof, will suggest various other modifications and applications of the same. It is accordingly desired that in construing the breadth of the appended claims they shall not be limited to the specific examples of the invention described herein.

I claim:

1. A fully sintered ferritic stainless steel powder compact being corrosion resistant in chloride ion environments consisting essentially of, by weight, 12 to 30% chromium, up to 8% molybdenum, up to 2% silicon, up to 1.5% manganese, up to 0.04% phosphorus, up to 0.04% sulfur, up to 0.15% carbon, balance iron; said steel compact having an overall density no greater than 80% of full density.

2. A sintered ferritic stainless steel according to claim 1, having from 16 to 26% chromium and from 2 to 6% molybdenum.

3. A sintered ferritic stainless steel according to claim 1, having an overall density of from 45 to 80% of full density.

4. A sintered ferritic stainless steel according to claim 3, having an overall density of from 68 to 80% of full density.

5. A sintered ferritic stainless steel according to claim 1, having from 16 to 26% chromium, from 2 to 6% molybdenum, up to 1.5% silicon, up to 0.5% manganese, up to 0.03% phosphorus, up to 0.03% sulfur, and up to 0.04% carbon.

6. A sintered ferritic stainless steel according to claim 5, having an overall density of from 45 to 80% of full density.

7. A sintered ferritic stainless steel according to claim 6, having an overall density of from 68 to 80% of full density.

* * * * *